US006938648B2

(12) United States Patent
Herrlein et al.

(10) Patent No.: US 6,938,648 B2
(45) Date of Patent: Sep. 6, 2005

(54) METHOD AND APPARATUS FOR REDUCING WEFT WASTE IN A GRIPPER WEAVING LOOM

(75) Inventors: Wilhelm Herrlein, Wangen (DE); Manuel Renz, Lindau (DE)

(73) Assignee: Lindauer Dornier Gesellshaft mbH, Lindau (DE)

( * ) Notice: Subject to any disclaimer, the term of this patent is extended or adjusted under 35 U.S.C. 154(b) by 189 days.

(21) Appl. No.: 10/401,938

(22) Filed: Mar. 27, 2003

(65) Prior Publication Data

US 2003/0183295 A1 Oct. 2, 2003

(30) Foreign Application Priority Data

Mar. 27, 2002 (DE) ..... 102 13 639

(51) Int. Cl.[7] ..... D03D 49/50
(52) U.S. Cl. ..... 139/116.1
(58) Field of Search ..... 139/166.1, 166.2, 139/443, 446, 449, 450, 117, 453, 212, 438

(56) References Cited

U.S. PATENT DOCUMENTS 4,143,684 A * 3/1979 Lindenmuller et al. ..... 139/450
4,840,203 A * 6/1989 Moeneclaey et al. ..... 139/453
5,199,468 A * 4/1993 Aarts et al. ..... 139/450
6,026,865 A 2/2000 Krumm et al.
6,155,309 A * 12/2000 Berktold ..... 139/450

FOREIGN PATENT DOCUMENTS

| | | |
|---|---|---|
| DE | 2531954 | 2/1976 |
| DE | 3042053 | 11/1982 |
| DE | 19739853 | 3/1999 |
| EP | 0240075 | 9/1992 |
| GB | 1519630 | 8/1978 |

* cited by examiner

*Primary Examiner*—John J. Calvert
*Assistant Examiner*—Andrew Sutton
(74) *Attorney, Agent, or Firm*—W. F. Fasse; W. G. Fasse

(57) ABSTRACT

In a gripper weaving loom which weaves several different types of weft threads into a fabric, it is desirable to keep weft material waste to a minimum. For this purpose a weft thread (7) already inserted into the loom shed is simultaneously held by a weft presenting clamp (13) and by a holding clamp (18). As soon as the weft is held by both clamps the weft is cut by a cutter (20) effective between the two clamps to form a trailing weft end (7B) of the already inserted weft and a leading weft end (7A) of a weft yet to be inserted. The holding clamp (18) keeps holding the trailing end (7B) until beat-up of the weft by the reed (4) is completed. For this purpose, the holding clamp (18) moves with the reed (4) into the beat-up position. When beat-up is completed the holding clamp (18) releases the trailing weft end (7B) and returns into a weft receiving position (22B). The weft presenting clamp (13) still holds the leading end (12A). The holding clamp (18) is arranged to move with the reed, while the cutter (20) is stationary between the two clamps.

20 Claims, 3 Drawing Sheets

METHOD AND APPARATUS FOR REDUCING WEFT WASTE IN A GRIPPER WEAVING LOOM

PRIORITY CLAIM

This application is based on and claims the priority under 35 U.S.C. §119 of German Patent Application 102 13 639.4, filed on Mar. 27, 2002, the entire disclosure of which is incorporated herein by reference.

FIELD OF THE INVENTION

The invention relates to a method and an apparatus for presenting a clamped weft thread to a weft insertion gripper that moves the weft thread into the loom shed. The presentation of the weft thread to the insertion gripper is performed so as to minimize weft waste.

BACKGROUND INFORMATION

European Patent Publication EP 0,240,075 B discloses a method and apparatus for minimizing weft waste, whereby at least two weft thread supply mechanisms are used for producing the fabric.

According to the known method substantially the following steps are performed.

1. At least two weft threads, including one first and one second weft thread, are to be sequentially inserted into the loom shed. Each weft thread is clamped by a respective clamp of a corresponding weft presentation lever of a presentation and clamping mechanism, whereby the presentation levers are in a position A.
2. A weft thread selector chooses in response to a control program between the two weft threads for presenting one of the two weft threads to a weft insertion gripper.
3. The respective presentation lever is moved into a second or presentation position B thereby bringing the selected weft thread into the moving path of the weft insertion gripper which takes over the weft thread for insertion into the loom shed.
4. The presentation lever is then moved into a position C which is located close to the insertion edge of the fabric on a line that is an extension of the beat-up line or an extension of the interlacing points along the beat-up line of a fabric being woven.
5. At this point the weft thread taken over by the gripper is still connected to the weft supply. After the insertion into the loom shed and after the beat-up the weft thread is clamped and held in the clamped position C by the respective clamp.
6. The beat-up weft thread is then cut between the selvage edge of the fabric and the clamp that is still in position C, thereby severing the trailing end of the inserted weft thread from the leading end of the clamped weft thread held ready for the next insertion.
7. The respective presentation lever, following the cutting of the weft thread, is held in the position C or it is moved back into the position A.

The above conventional method and the conventional apparatus for performing the known method have a significant disadvantage, namely that each type of weft thread to be inserted into the loom shed necessarily has a different length of weft waste. This is so because each weft presenting clamp of a plurality of weft presenting clamps has a different spacing from the fabric weft entrance edge. More specifically, the weft clamp positioned closest to the fabric edge yields the smallest length of weft waste. The weft waste for the next weft thread is larger than that of the first weft thread and so on so that the weft waste increases from weft thread to weft thread in a group of a plurality of weft threads. The increasing weft waste lengths are determined by the construction of the loom and present a substantial disadvantage. A further conventional disadvantage is seen in that the weft thread is cut in the area where the reed performs its beat-up. As a result, the weft thread must be pulled out all the way to the interlacing point. In order to reduce the weft waste, the known apparatus employs a pull-back mechanism that pulls back the next weft thread to be inserted after it has been cut near the interlacing point or beat-up line. The weft pull back mechanism is additionally necessary to maintain the required weft tension for the next following weft insertion.

The above described functions are performed by a conventional apparatus that has a mechanism for presenting and clamping the weft threads in a gripper loom. The known apparatus comprises essentially a weft presenting lever equipped with a thread clamp for each weft thread to be inserted into the loom shed. The weft presenting levers are positioned next to each other and approximately in parallel to the fabric edge or selvage on the weft insertion side of the loom shed. The clamp of the first weft presenting lever is positioned closest to the fabric edge when the clamp is in the positions A and C. The clamp on the last weft presenting lever is positioned furthest away from the fabric edge. Thus, it is clear that the free length of weft thread becomes longer and longer starting at the first position of the first clamp and increasing with the following clamps. The weft thread cutter is mounted in a fixed position next to the fabric edge and cuts longer and longer weft thread ends. Moreover, as a rule, the longer the weft thread between the clamp and the weft cutter, the smaller is the thread tension. However, it is desirable that a certain assured tension is present in the weft thread as it is cut. As a result, the known apparatus does not ensure that the selvage along the weft entrance side of the loom shed is always meeting the required quality standards.

German Patent Publication DE-OS 25 31 954 discloses a controllable weft thread clamping mechanism comprising a plurality of clamping points. Each clamping point is displaceable or adjustable relative to a reference plane. Further, the clamping points are arranged at equal spacings from one another and one above the other. One clamping position at a time can be shifted into the reference plane. Each clamping position is constructed to cooperate with a controlled weft thread selector. These weft thread selectors are known as such. This combination of a clamping position with a controlled weft thread selector has the advantage that the weft thread to be inserted into the loom shed can be transported into a first reference plane where the weft insertion gripper can seize the weft thread without any problems. Another advantage of the known apparatus is seen in that the respective clamping position can be moved into a second reference plane which corresponds to the position of the interlacing point at the fabric edge. This conventional feature makes it possible that when the weft thread is beat-up to the beat-up line of the fabric, the weft thread is clamped by the respective clamping position of the clamping mechanism and is held in tension at the entrance side of the loom shed between the fabric edge and the clamping position. This tension in the weft thread at this position is advantageous for the cutting by the weft cutter or scissors mounted between the clamping position and the fabric edge. However, the weft waste cannot be minimized with such an arrangement because the weft threads cannot be presented directly to the weft insertion gripper.

German Patent Publication DE 30 42 053 C1 discloses a weaving loom with an apparatus for reducing weft thread waste. However, the known weaving loom employs rather complicated features or mechanisms for the reduction of weft waste. These mechanisms in combination with the cutter for severing the beat-up weft thread is technically quite involved and correspondingly prone to trouble. In the known apparatus the cut-off trailing end of the inserted and beat-up weft thread is stretched by pneumatically effective nozzles, which due to their pneumatic nature require a weft thread end that cannot be relatively short.

German Patent Publication DE 197 39 853 C2 discloses a weft thread presenting and clamping mechanism with a plurality of weft presenters each of which is equipped with a clamp. These presenters and clamps are arranged in the loom for cooperation with at least one weft pull-back mechanism. The cooperation with the pull-back mechanism is such, that all weft threads of a group of weft threads are presented approximately in the same point to the weft insertion gripper in order to realize a minimum of weft waste. All wefts of a group are to be inserted into a loom shed in a predetermined sequence as controlled weft selector.

OBJECTS OF THE INVENTION

In view of the foregoing it is the aim of the invention to achieve the following objects singly or in combination:

- to provide a method and apparatus for minimizing weft thread waste while simultaneously avoiding the above outlined disadvantages of the prior art;
- to avoid cutting a weft thread that has already been inserted and beat-up in the loom shed at the point where interlacing occurs, in other words, to cut the weft thread immediately upon completion of the weft insertion, preferably at the beginning of a beat-up motion of the reed of the loom;
- to avoid the use of a weft pull-back mechanism while still assuring that the weft thread is held at the proper tension at least when the weft is cut; and
- to make sure that a minimum cut-off length is uniform for all inserted weft threads of a group of weft threads to assure the formation of a quality selvage at the entrance edge of the loom shed.

SUMMARY OF THE INVENTION

The above objects have been achieved according to the invention by the combination of the following weft handling steps and structural features of the present loom. Immediately following the insertion of a weft thread into the loom shed and prior to the beat-up of the inserted weft thread the latter is gripped by a first weft presentation clamp and by a second weft holding clamp, referred to herein as first and second clamps or as presenting clamp and holding clamp. Immediately following the clamping by the first and second clamps, the weft is cut by a weft cutter positioned between a weft presentation position of the first clamp that presents the weft thread to a weft insertion gripper and a weft take-up position of the second clamp that holds the weft thread. The cutting occurs during the beat-up motion of the loom reed, preferably immediately at the beginning of the beat-up motion. The cutting of the weft thread produces a trailing weft end of the inserted weft thread and a leading weft end of the weft thread waiting for a following insertion. The sequence of insertion of different weft threads depends on the weaving pattern. An immediately following insertion may use the same weft thread or it may use another weft thread in a sequence of other weft threads. The invention is equally suitable for all types of weft insertions. The trailing weft end is held by the second clamp until weft beat-up is completed. For this purpose the second clamp travels along with the reed in the beat-up direction. Once beat-up is completed, the second clamp releases the trailing weft end and travels back into its weft take-up position. For this purpose the motion of the second clamp is coordinated or even synchronized in part with the motion of the reed. The weft presenting or first clamp keeps holding the leading end of the weft while the first clamp is returned into the weft presentation position, but not necessarily in coordination with the reed motion because another weft presenting clamp may be effective for the next weft insertion while the second clamp cooperates with all weft insertion first clamps forming a group of, for example, six weft presenting clamps.

The motion of the second clamp according to the invention is, as mentioned above, coordinated or synchronized with the reed motion. As a result, the second clamp can advantageously cooperate with any one of a plurality of weft thread presenting first clamps. A further advantage is seen in that the weft cutter can be positioned away from the beat-up line. Thus, the invention achieves advantageously that the weft thread can be cut during the motion of the reed in its beat-up motion direction toward the beat-up line of the fabric. Further, according to the invention the motion sequence of the plurality of weft presenters with their first clamps and their position are so selected that in both positions of the presenting clamps, namely in the rest position and in the presenting position, the weft thread is equally tensioned. As a result, the invention achieves a very small waste of weft threads compared to conventional weft waste, without the need for a weft pull-back mechanism.

The foregoing advantages are achieved even if a plurality of weft presenters with their first clamps cooperate with the single second clamp in sequence for presenting, for example weft threads of different colors substantially at the same presentation point (16) for the insertion gripper to efficiently seize the respective weft thread, whereby for each weft thread a uniformly minimal weft waste is achieved.

The above described sequence and the conventional operations of a gripper weaving loom is controlled by the electronic loom control unit which controls the individual components of the loom such as the weft thread presenters, the insertion gripper, the withdrawal gripper, the reed, the holding or second clamp, and the weft cutter. The drive of the loom components can take place either by a central loom control drive, whereby the drive power is derived from the main loom drive shaft or the individual components can be operated by electromotor drives which are individually controlled by the main loom control.

A loom according to the invention is characterized in that the above mentioned holding or second clamp is mounted next to the weft insertion edge of the loom shed and that this second clamp is coordinated or synchronized in its motion with the motion of the loom reed for holding the cut-off or trailing end of an inserted weft thread and that the weft cutter is positioned close to the weft presentation point (16) of a weft presenting or first clamp and between the weft presenting first clamp and the weft holding second clamp.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
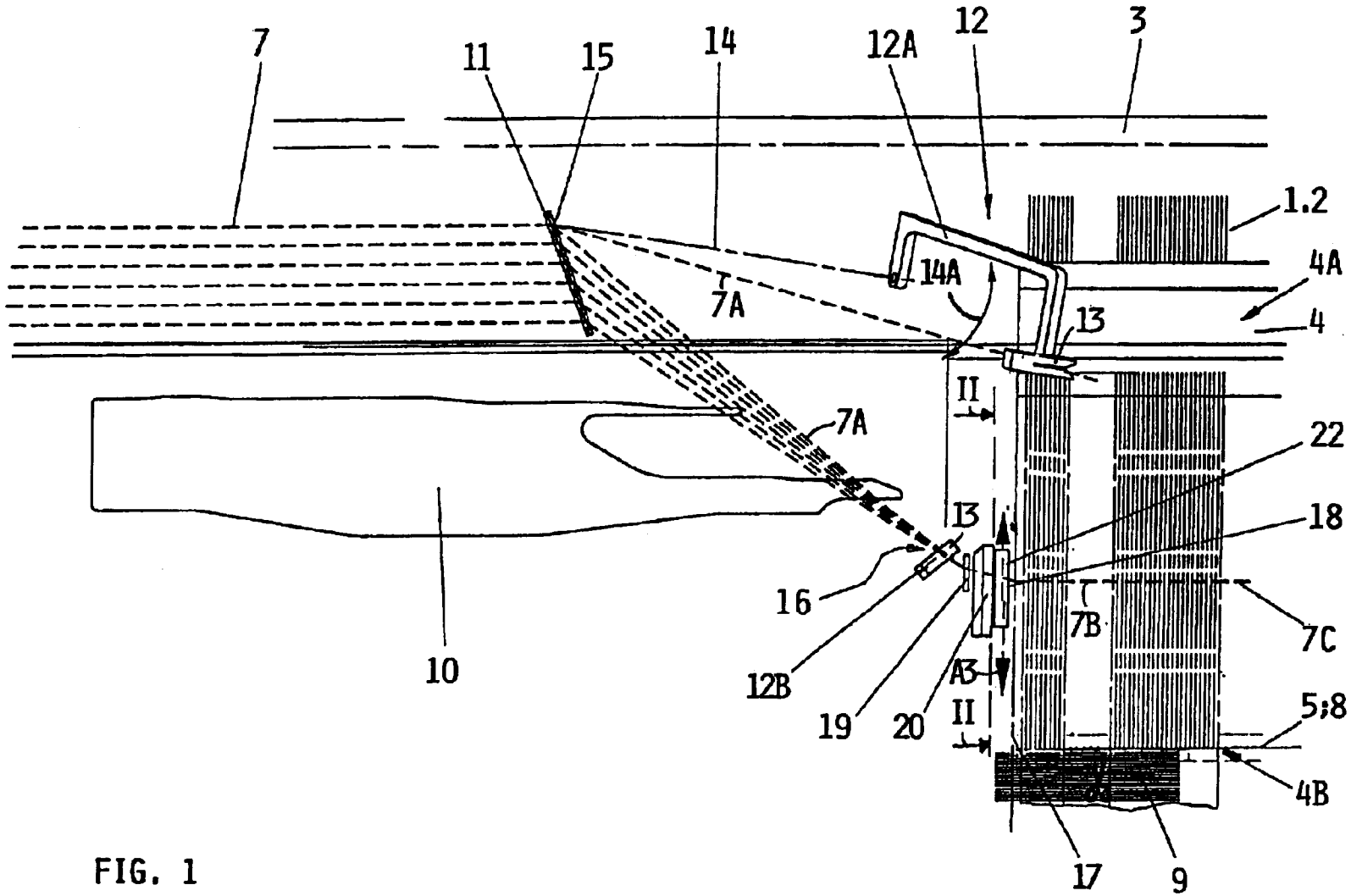
FIG. 1 is a schematic illustration of a first embodiment according to the invention showing a weft presenter with its weft presenting first clamp performing a circular back and forth motion between a rest position and a presenting position.
Figure 2:
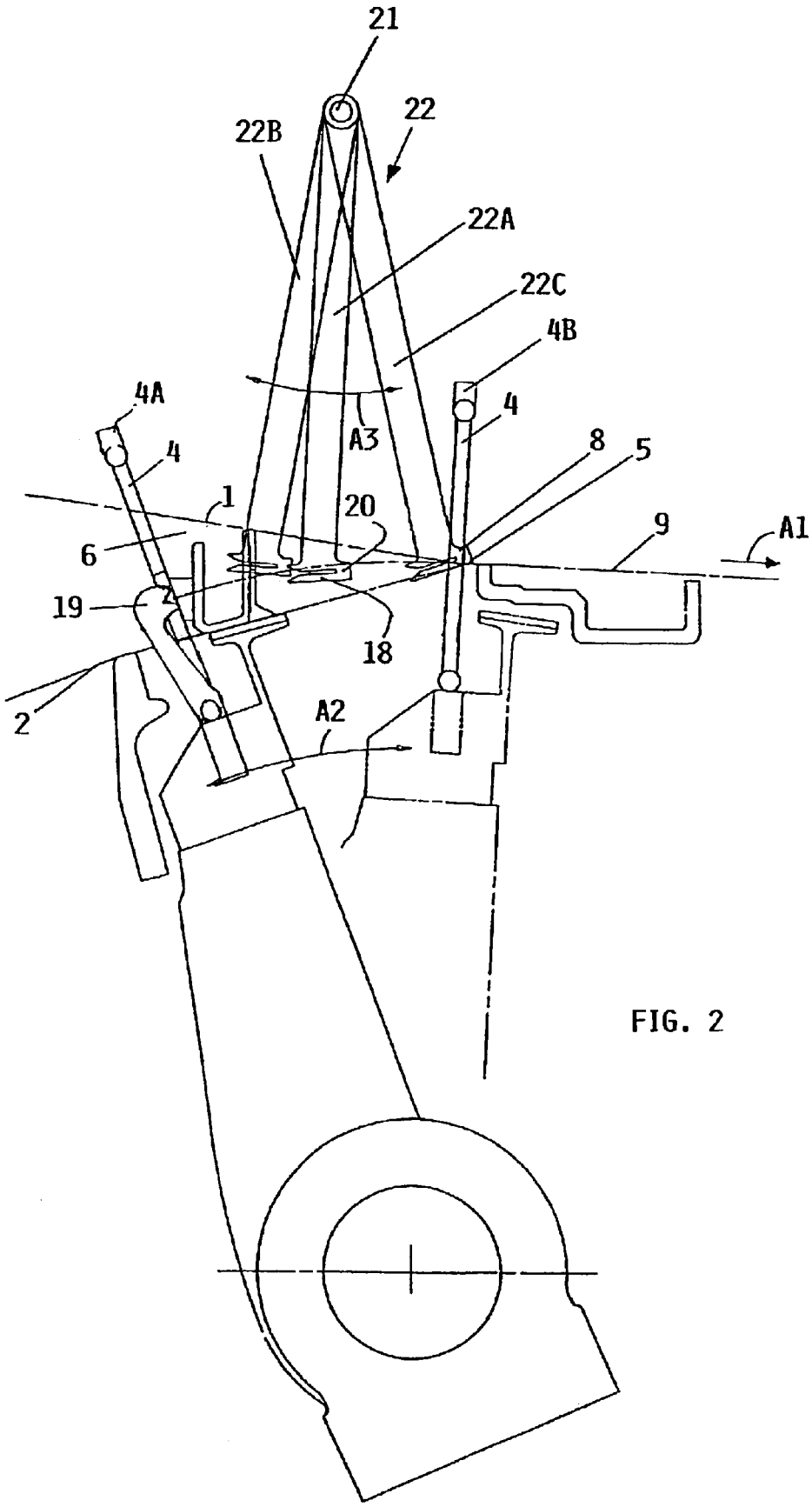
FIG. 2 is a view in the direction of the plane II—II in FIG. 1 or 3 for illustrating the holding or second clamp according to the invention.

FIGS. 1 and 2 illustrate schematically the weft insertion side of a weaving loom. FIG. 2 shows the upper warp threads 1 and the lower warp threads 2 forming a loom shed 6. The warp threads 1 and 2 pass through the loom heald frame or shafts 3 and through the lamellae of the loom reed 4 toward the interlacing point 5 which is positioned in a weft beat-up line 8. The shed 6 is formed upstream of the beat-up line 8 and a fabric 9 is formed along the beat-up line 8. The fabric 9 travels in the direction of an arrow A1 away from the beat-up line 8. FIG. 1 shows, for example, six different weft threads 7 which are inserted into the loom shed 6 by a weft insertion gripper 10. Once a weft thread 7C is inserted into the loom shed 6 it is beat-up by the reed 4 that moves back and forth between the full line back position and the dashed line beat-up or forward position as shown in FIG. 2 by an arrow A2. Once the weft insertion gripper 10 has moved a weft thread into the loom shed 6, a weft withdrawal gripper not shown, moves the weft thread entirely through the loom shed prior to beat-up. The finished fabric 9 is continuously withdrawn in the direction of the arrow A1.

FIG. 1 illustrates only one weft presenter 12 to simplify the illustration. However, since there are, for example six weft threads 7 supplied by respective spools not shown, there will be used six weft presenters 12. A thread guide 11 having, for example six thread guide eyes 15, guides the weft threads 7 so that the respective weft presenter 12 carrying a first clamp 13 shown in its rest position 12A and schematically in its weft presenting position 12B, can pick-up its weft thread leading end 7A. As shown in FIG. 1 each weft presenter 12 shown in its rest position 12A has a bail configuration which forms a tiltable or swivelable lever that carries at its free end the weft presenting or first clamp 13 and is journaled at its opposite end on a journal axis 14. Thus, the weft presenter 12 is movable back and forth along a sector of a circular motion as indicated by the double arrow 14A that has its center in the journal axis 14. Preferably, the journal axis 14 passes through the respective thread guide eye, for example guide eye 15. The clamp 13 clamps that part of the weft thread 7, which will become the leading end 7A of a respective weft thread 7 after cutting. More specifically, the weft presenter 12 is movable about the journal axis 14 from its rest position 12A to its weft presenting position 12B and back again. By passing the respective journal axis 14 through the corresponding thread guide eye 15 it is assured that the spacing between the thread guide eye 15 and the weft presenting or first clamp 13 remains constant which has the advantage that the thread tension in the leading end 7A of the weft is also constant in any position of the thread presenter 12. Each thread presenter 12 in its thread presenting position 12B presents the weft thread to the insertion gripper 10 in substantially the same presenting point 16. The term "substantially" as used in the present context means that the presenting point 16 may vary slightly from one presenter to the other as long as the leading weft end 7A is properly presented to the gripper 10 as shown in FIG. 1.

If a weft thread 7 is selected by a weft selector controlled by the main loom control not shown, the weft presenter 12 moves from its rest position 12A to its presenting position 12B which is located next or close to the weft insertion edge 17 of the fabric 9. In FIG. 1 only the weft presenting clamp 13 is shown in the presentation position 12B to hold the weft thread leading end 7A in the presenting point 16 for seizing by the gripper 10 which moves the weft thread into the open loom shed 6. Approximately in the center of the shed the weft thread is taken over by a second gripper, not shown, which pulls the thread entirely through the shed to the exit side of the shed. Once the weft thread has been taken over by the second gripper, the insertion gripper 10 returns to its position outside of the loom shed ready for the next weft insertion.

When the weft insertion is complete, the reed 4 is moved out of its back position 4A into the dashed line beat-up position 4B as shown in FIG. 2 by the arrow A2. As the reed 4 moves clockwise or forward in FIG. 2, the inserted weft thread 7C is pushed toward the interlacing point 5 and beat-up along the beat-up line 8. At this time the weft presenter 12 with its presenting or first clamp 13 is still in the presenting position 12B. As the weft thread 7C is pushed toward the beat-up line 8 prior to cutting the part of the weft thread that after cutting will become the leading end 7A of the weft thread, is clamped by the weft presenting or first clamp 13 for holding the leading weft end 7A in the presenting point 16. Thus, a portion of the weft thread not yet cut is held between the weft presenting first clamp 13 and a weft holding second clamp 18 in a position for cutting by a weft cutter 20.

The insertion of the weft thread into the first clamp 13 and into the second clamp 18 can be facilitated by a presenting hook 19 arranged laterally of and operatively connected to the reed 4 as best seen in FIG. 2. The presenting hook 19 moves with the reed 4 and aids in the reliable insertion of the weft thread 7 into both clamps 13 and 18. Using the presenting hook 19 is not necessarily required, but its use may rather depend on the type of weft threads to be woven.

As soon as the weft thread 7 has been reliably clamped by the first clamp 13 and the second clamp 18 the weft will now be cut by the weft cutter 20 such as scissors which are positioned close to the weft presenting position 12B of the weft first clamp 13. This cutting according to the invention takes place while the reed 4 is still moving toward the beat-up position 4B. Preferably, the cutting takes place as soon as possible following the s beginning of the clockwise beat-up movement of the reed 4.

The cutting of the weft thread results in a trailing weft end 7B of the inserted weft thread 7C and in a leading weft end 7A of the weft thread to be inserted in its following sequence.

The cut-off trailing end 7B is held by the holding second clamp 18 while the leading end 7A of a weft end 7 coming from a supply spool not shown is held by the presentation first clamp 13 for presenting the leading end 7A to the insertion gripper 10. Depending on the controlled selection of the weft thread sequence, the next leading weft end to be inserted is not necessarily the leading end of the weft thread that has just been cut. Rather, a leading end next to be inserted may be part of any of the other five weft threads that have been previously cut and were held by its own weft presenting first clamp 13.

FIG. 2 shows one embodiment of a drive mechanism for imparting the required motion to the second clamp 18. For this purpose the second clamp 18 is mounted to the free end of a journal lever 22 that is journaled to a journal axis 21 for moving back and forth as indicated by the arrow A3, between a back position 22B through a central position 22A to a forward position 22C. This motion of the journal lever 22 and thus of the holding clamp 18 is controlled by the main loom control and follows the motion of the loom reed 4 to the beat-up position 4B, but does not need to go all the way to the rear position 4A of the reed 4. Thus, the lever 22 follows the reed motion only substantially.

As shown in FIG. 2 following a weft insertion into the loom shed 6 the journal lever 22 is in the central position 22A. As the reed 4 moves clockwise in the direction of the arrow A2 toward the beat-up line 8 the reed passes into the area of the central position 22A of the journal lever 22 carrying the holding clamp 18. At the same time, the lever 22 moves backward to its back position 22B, toward the back position 4A of the reed 4. Thus, the weft thread that will be beat-up comes with its trailing end into the range of the holding second clamp 18 which seizes and clamps the weft thread. From the position 22B where the weft thread has been clamped, the journal lever 22 moves into its forward position 22C toward the beat-up line 8 substantially in synchronism with the motion of the reed 4. The dashed line of the reed 4 in FIG. 2 indicates the reed beat-up position 4B. When the reed 4 is in the position 4B the second clamp 18 is opened to release the trailing end 7B of the now beat-up weft thread 7C. The journal lever 22 can now return into its central position 22A.

While the journal lever 22 with its second clamp 18 moves back into the central or starting position 22A, the weft presenter 12 with its first clamp 13 also tilts back into its rest position 12A in order to make room for another weft presenter 12. However, if the same weft thread is to be again inserted then the weft presenter 12 can remain in its weft presenting position 12B.

Figure 3:
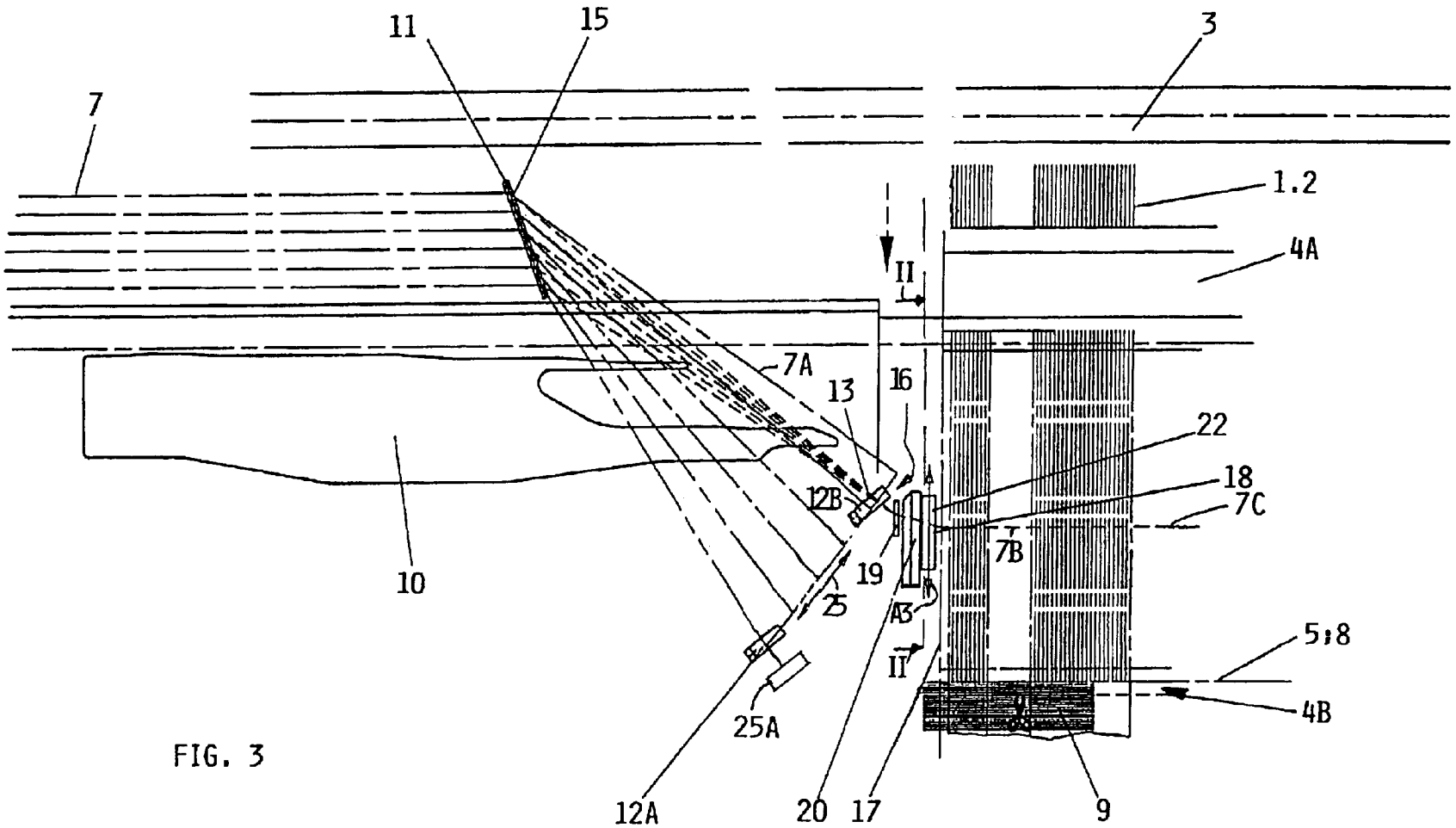
FIG. 3 is a view similar to that of FIG. 1, however illustrating a second embodiment according to the invention of the weft presenting mechanism and of the clamping mechanism with a linear motion of the weft presenting first clamp or clamps rather than a circular motion.

FIG. 3 shows a modified embodiment of the invention in which the weft presenter 12 with its first clamp 13 moves along a linear path 25 between its rest position 12A and its weft presenting position 12B next to the cutter 20. A linear drive 25A drives the respective weft presenter 12 along the linear path 25. Each weft presenter 12 or rather its weft presenting first clamp 13 can thus be moved into the weft presenting point 16 which is substantially the same for all presenters 12. The linear movement path 25 of the weft presenter 12 from its rest position 12A to the presenting position 12B and back again is so selected that the leading weft end 7A clamped by the first clamp 13 is held in tension at least in the rest position and in the weft presenting position. It is not critical if the tension is not constant between the rest position 12A and the weft presenting position 12B when the presenter moves between these two positions as long as the tension is the same in both end positions. Following the positioning of the weft thread leading end 7A in the presentation point 16, the insertion gripper 10 seizes the weft thread and moves it into the loom shed 6. The following steps in the sequence of operation is the same as that described above with reference to FIGS. 1 and 2.

The linear motion of the weft presenter 12 and its clamp 13 can, for example, be derived from a piston cylinder drive or from a cam drive or from a linear electric motor. Similarly, rather than carrying the holding or second clamp 18 on a swiveling or journal lever 22 it is possible to move the holding clamp along a linear path between its end positions. However, a motion of the holding or second clamp 18 along its circular path is preferred for facilitating the coordination or at least partial synchronization with the motion of the reed 4.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for reducing weft waste in a weaving loom having a weft insertion gripper, said method comprising the following steps:

a) clamping a weft thread (7) following insertion of the weft thread into a loom shed (6) by a weft presenting first clamp (13) and by a weft holding second clamp (18) on a weft insertion side of said loom shed (6), b) moving said first and second clamps (13, 18) with a beat-up motion of a reed (4) toward an axial extension of a beat-up line (8), c) cutting said weft thread between said first and second clamps (13, 18) while said first and second clamps are still following said beat-up motion of said reed (4), to form a leading weft end (7A) of a weft (7) yet to be inserted into said loom shed (6) and a trailing weft end (7B) of an inserted weft (7C), d) continuing to hold said trailing weft end (7B) by said second clamp (18) until beat-up is completed, e) opening said second clamp (18) to release said trailing weft end (7B) and returning said second clamp (18) into a starting position (22A), and f) returning said first clamp (13) still holding said leading weft end (7A) into a rest position (12A).

2. The method of claim 1, further comprising operating a weft guide member (19) for feeding said weft thread into said first and second clamps (13, 18) for clamping.

3. The method of claim 1, further comprising mounting said second clamp (18) to a movable member (22), moving said movable member in coordination with said beat-up motion of said reed (6) between a back position and a beat-up position, clamping said weft thread with said second clamp in said back position, and releasing said weft thread by said second clamp in said beat-up position when beat-up is completed.

4. The method of claim 3, further comprising performing said moving step of said movable member (22) carrying said second clamp (18) as a swiveling back-and-forth circular motion about a journal axis (21).

5. The method of claim 3, further comprising performing said moving step of said movable member (22) carrying said second clamp (18), as a linear or substantially liner motion along a linear or substantially linear path.

6. The method of claim 1, further comprising using a plurality of first clamps (13) for handling a respective plurality of weft threads, mounting each of said first clamps (13) to a respective weft presenter (12) of a plurality of weft presenters (12), swiveling each of said weft presenters at a respective time about a swivel axis (14) for moving a respective one of said weft presenters back-and-forth between a rest position (12A) and a weft presenting position (12B) at a weft presenting point (16) in which said gripper (10) seizes maid weft thread (7), and guiding said weft presenters (12) so that each weft presenter (12) moves its respective first clamp (13) substantially to said weft presenting point (16).

7. The method of claim 6, further comprising locating said swivel axis (14) in such a position that said weft thread is tensioned as long as said weft thread is held by its respective first clamp (13) during said back and forth moving of the respective weft presenter (12) thereby tensioning said weft thread at all times.

8. The method of claim 6, further comprising using a plurality of first clamps (13) for handling a respective plurality of weft threads, mounting each of said first clamps (13) to a respective weft presenter (12) of a plurality of weft presenters, moving each said weft presenter along a linear path (25) so that each weft presenter (12) moves its respective firs clamp (13) to a weft presenting point (16) that is substantially the same for all first clamps (13).

9. The method of claim 8, further comprising positioning said linear path (25) so that said weft thread is held by said first clamp (13) in a stretched condition at least when said weft presenter (12) with said first clamp (13) is in a weft presenting position (12B) and when the weft presenter is in a rest position (12A).

10. The method of claim 1, further comprising maintaining said weft presenter (12) with said first clamp (13) in a weft presenting position (12B) in response to a selection of the same weft thread for insertion into the immediately following loom shed.

11. The method of claim 1, further comprising controlling the motion of said weft presenter (12), the opening and closing of said presenter first clamp (13), the motion of a lever (22) holding said second clamp, the opening and closing of said second clamp (18) and the operation of a cutter (20) in response to a rotational angle of a main loom drive shaft.

12. The method of claim 1, further comprising operating said first clamp or clamps (13) indirectly by deriving a drive power for said first clamp or clamps (13) form a main loom drive.

13. The method of claim 1, further comprising operating said second clamp (18) indirectly by deriving a drive power for said second clamp (18) from a main loom drive.

14. The method of claim 1, further comprising operating said first clamp or clamps (13) directly by deriving a drive power for said first clamp or clamps from a respective drive motor that is controllable by a main loom control.

15. The method of claim 1, further comprising operating said second clamp (18) directly by deriving a drive power from a respective drive motor that is controllable by a main loom control.

16. An apparatus for reducing weft waste in a gripper weaving loom, said apparatus comprising a reed (4), a weft insertion gripper (10) for moving into and out of a loom shed (6), at least one weft (7), a movable weft presenter (12) for said at least one weft (7,) a weft presenting first clamp (13) mounted to its respective movable weft presenter (12) for movement between a rest position (12A) and a weft presenting position (12B) for presenting a leading weft end (7A) to said gripper (10), a weft holding second clamp (18) movably mounted in said weaving loom for at least partly following a beat-up movement of said reed (4) toward an axial extension of a beat-up line (8), a weft cutter (20) mounted in a stationary position next to said weft presenting position (12B) of said weft presenting first clamp (13) and next to a weft entrance edge (17) of said loom shed (6), whereby said cutter (20) is effective between said first clamp (13) and said second clamp (18) while said first and second clamps (13, 18) are still following said beat-up movement of said reed (4), and said second clamp (18) is still holding a trailing weft end (7B) until beat-up is completed and said first clamp is still holding a leading weft end (7A) even after beat-up is completed.

17. The apparatus of claim 16, further comprising a tiltable journal lever (22) having a journaled end mounted to a journal axis (21) and a free end, said weft holding second clamp (18) being operatively mounted to said free end of said journal lever (22) for at least partly following said beat-up movement of said reed (4).

18. The apparatus of claim 16, wherein each said movable weft presenter (12) has a free presenter end and a tiltable presenter end journaled to a tilting axis (14), said weft presenting first clamp (13) being operatively mounted to said free presenter end of said weft presenter (12).

19. The apparatus of claim 16, comprising linear drive means (25A) for driving said weft presenter (12) with its weft presenting first clamp (13) along a linear path (25) back-and-forth between said rest position (12A) and said weft presentig position (12B).

20. The apparatus of claim 16, further comprising a weft guiding guide member (19) operatively mounted to said reed (4) between said weft presenting position (12B) of said weft presenter (12) and said weft cutter (20) for facilitating an insertion of said weft (7) into said first clamp (13) and into said second clamp (18).

* * * * *

UNITED STATES PATENT AND TRADEMARK OFFICE

CERTIFICATE OF CORRECTION

PATENT NO. : 6,938,648 B2
DATED : September 6, 2005
INVENTOR(S) : Herrlein et al.

It is certified that error appears in the above-identified patent and that said Letters Patent is hereby corrected as shown below:

Title page,
Item [73], Assignee, replace "Gesellshaft" by -- Gesellschaft --;

Column 4,
Line 34, after "threads", insert -- , --;

Column 6,
Line 57, before "beginning", delete "s";

Column 8,
Line 60, after "substantially", replace "liner" by -- linear --;

Column 9,
Line 4, after "seizes", replace "maid" by -- said --;
Line 20, before "clamp", replace "firs" by -- first --;
Line 42, after "(13)", replace "form" by -- from --;

Column 10,
Line 42, after "weft", replace "presentig" by -- presenting --.

Signed and Sealed this

Thirty-first Day of January, 2006

JON W. DUDAS
*Director of the United States Patent and Trademark Office*